United States Patent [19]

Frank et al.

[11] Patent Number: 4,834,062

[45] Date of Patent: May 30, 1989

[54] MULTIBLADE INNER HOLE SAW FOR THE SAWING OF CRYSTAL RODS INTO THIN BLADES

[75] Inventors: Walter Frank, Burgkirchen, Fed. Rep. of Germany; Gerhard Palme, Oberndorf, Austria

[73] Assignee: Wacker Chemitronic, Burghausen, Fed. Rep. of Germany

[21] Appl. No.: 201,356

[22] Filed: May 26, 1988

Related U.S. Application Data

[63] Continuation of Ser. No. 002,305, Jan. 9, 1987, abandoned.

[30] Foreign Application Priority Data

Feb. 24, 1986 [DE] Fed. Rep. of Germany ..... 3604739

[51] Int. Cl.[4] ..... B28D 1/04

[52] U.S. Cl. ..... 125/13 R; 125/15; 51/73 R; 83/42; 83/488

[58] Field of Search ..... 51/73 R; 125/13 R, 15; 83/42, 488

[56] References Cited

U.S. PATENT DOCUMENTS

| | | | |
|---|---|---|---|
| 3,051,207 | 8/1962 | Hartley | 83/729 |
| 3,154,990 | 11/1964 | Woods | 125/13 R |
| 3,175,548 | 3/1965 | Weiss | 125/15 |
| 3,261,383 | 7/1966 | Coblentz | 125/13 R |
| 3,662,733 | 5/1972 | Okamoto | 125/13 R |
| 3,879,896 | 4/1975 | Maxfield | 125/13 R |
| 4,004,477 | 1/1977 | Mitchell | 83/409.1 |
| 4,116,095 | 9/1978 | Cousinu | 83/488 |
| 4,128,119 | 12/1978 | Maier | 83/409.1 |
| 4,131,103 | 12/1978 | Ishizuka | 125/13 R |
| 4,150,912 | 4/1979 | Gutsche | 125/15 |
| 4,227,348 | 10/1980 | Demers | 125/13 R |
| 4,513,544 | 4/1985 | Lossl | 125/15 |

*Primary Examiner*—Robert P. Olszewski

*Attorney, Agent, or Firm*—Burgess, Ryan & Wayne

[57] ABSTRACT

A multi-blade inner hole saw for the sawing of crystal rods or blocks, such as solar cell base material on a silicon base, into thin wafers has saw blades arranged mirror-symmetrically with respect to the bearing on either side of a common drive cylinder. In the sawing operation, the workpieces are sawn synchronously by the saw blades.

8 Claims, 4 Drawing Sheets

MULTIBLADE INNER HOLE SAW FOR THE SAWING OF CRYSTAL RODS INTO THIN BLADES

This application is a continuation, of application Ser. No. 002,305, filed Jan. 9, 1987 now abandoned.

BACKGROUND OF THE INVENTION

The present invention relates to a multi-blade inner hole saw for the sawing of crystal rods into thin wafers and separating operations carried out by means of this saw.

For the manufacture of electronic components or solar cells, it is often necessary to provide the semiconductor or oxidic material used, that is, silicon, germanium, gallium arsenide, indium phosphide, sapphire or gallium-gadolinium garnet, in the form of thin wafers of, typically, 0.1 to 1 mm thickness. These thin wafers are obtained as a rule by sawing the starting material which is available in the form of crystal rods or blocks. In most cases, this sawing operation is carried out with the aid of inner hole saws.

In the case of known inner hole saws, the saw blade is braced at the outer edge in a frame. This is held by a cup-like widening frame support, which is attached at one end of a drive cylinder borne usually by means of a ball, air or hydrodynamic bearing and set in rotation via a drive unit. This one-sided, top-heavy arrangement causes an uneven stressing of the bearings, which reduces the wear resistance and service life, and a slight inclination of the saw blade, which has unfavorable effects on the cutting profile and the cutting accuracy. This effect is all the more marked the more top-heavy the arrangement is, so that inner hole saws with several saw blades, for example, according to German Offenlegungsschrift No. 3,216,200 the entire disclosure of which is incorporated herein by reference, are naturally more affected than those with only one saw blade. The higher cutting capacity is therefore always achieved with multi-blade arrangements at the expense of cutting precision and service life, which is unsatisfactory in view of constantly increasing accuracy requirements.

OBJECTS AND SUMMARY OF THE INVENTION

Accordingly, it is an object of the invention to provide a multi-blade inner hole saw and separating operations carried out by means of this saw, by which a high cutting accuracy and long service life are ensured in the case of high cutting capacities.

It is another object of the invention to provide a multi-blade inner hole saw which is characterized by saw blades or saw blade groups arranged mirror-symmetrically with respect to the bearing on either side of a common drive cylinder.

The sawing operation carried out by means of such an arrangement is characterized in that the workpieces to be sawn, the number of which correspond to the number of saw blades or saw blade groups, are brought into the respective cutting position before each cutting operation by a same-direction or counter-direction translational movement and simultaneously subjected to a sawing operation by a synchronous relative movement between, in each case, the saw blade or the saw blade group, and in each case, one workpiece.

Individual crystal rods or blocks and groups made up of these, such as rod bundles, may be used as workpieces here.

In most cases, the multi-blade inner hole saw according to the invention is used with one saw blade on either side of the drive cylinder. An increase in the sawing capacity can be achieved, however, by the use of saw blade groups. Saw blade groups are to be understood here as arrangements in which there are, on each side of the drive cylinder, several, advantageously two, saw blades, the spacing of which from one another may be smaller, equal to or greater than the length of an individual workpiece to be sawn. Expediently, the spacing is, in the case of n saw blades, set at most to the nth part of the workpiece length, n being a whole number greater than or equal to 2. The possible minimum spacing is greater than the sum of the wafer thickness desired in each case and the kerf thickness chosen and is appropriately about 4 mm. For reasons of simplicity, from now on, only the expression "saw blade" is used. However, the statement also applies analogously to saw blade groups.

The closest spacing between the saw blades arranged mirror-symmetrically on either side of the common drive cylinder depends on which way the workpieces are brought into the respective cutting position. While with a same-direction translational movement this spacing is in any event chosen greater than the workpiece length, with a counter-direction translational movement of the workpieces into the cutting position, it may be either smaller or greater. However, in cases where the wafers are completely separated in each cutting operation, spacings below the workpiece length require the use of removal devices, so that their necessary range of action between the saw blades determines the minimum possible spacing. In principle, the spacings between the saw blades or saw blade groups in the case of the multi-blade inner hole saw according to the invention may vary within broad limits dependent on the bearing used in each case and the position of the saw blades. Spacings of 3 to 200 cm have proven successful.

The common drive cylinder, on either side of which the blades are arranged mirror-symmetrically with respect to the bearings, is preferably used with an internal diameter which is greater than the inner hole diameter of the saw blades and advantageously corresponds approximately to the internal diameter of the clamping system in which it is braced. These requirements can be favorably met with the aid of drive cylinders borne on the outside by means of magnet, air or hydrodynamic bearings. The outer bearing of rotating systems by means of such bearings is known in principle and is used in many other areas, for example, in the case of centrifuges. A person skilled in the art also knows of various possibilities for the power transmission from the actual drive unit, such as an electric motor, to this drive cylinder, for example, by means of belts, and they therefore do not require any further explanation here.

The advantage of a large internal diameter of the drive cylinder, preferably corresponding approximately to the internal diameter of the frame, is that, in cutting operations in which the crystal rods are initially dissected into a plurality of wafers joined to one another, without removal, the workable length of the workpiece is not restricted by the cup-shaped narrowing shape of the frame support as in the case of conventional inner hole saws. In principle, however, embodiments modelled on the conventional inner hole saws with wide frame and narrow drive cylinder are also conceivable in which, for example, a central narrow drive cylinder is widened cup-shaped on either side to receive the frame.

In principle, the frames and saw blades may also be arranged within the drive cylinder.

The above and other objects, features and advantages of the present invention will become readily apparent from the following description which is to be read in connection with the accompanying drawing.

DETAILED DESCRIPTION OF THE PREFERRED EMBODIMENT

Figure 1:
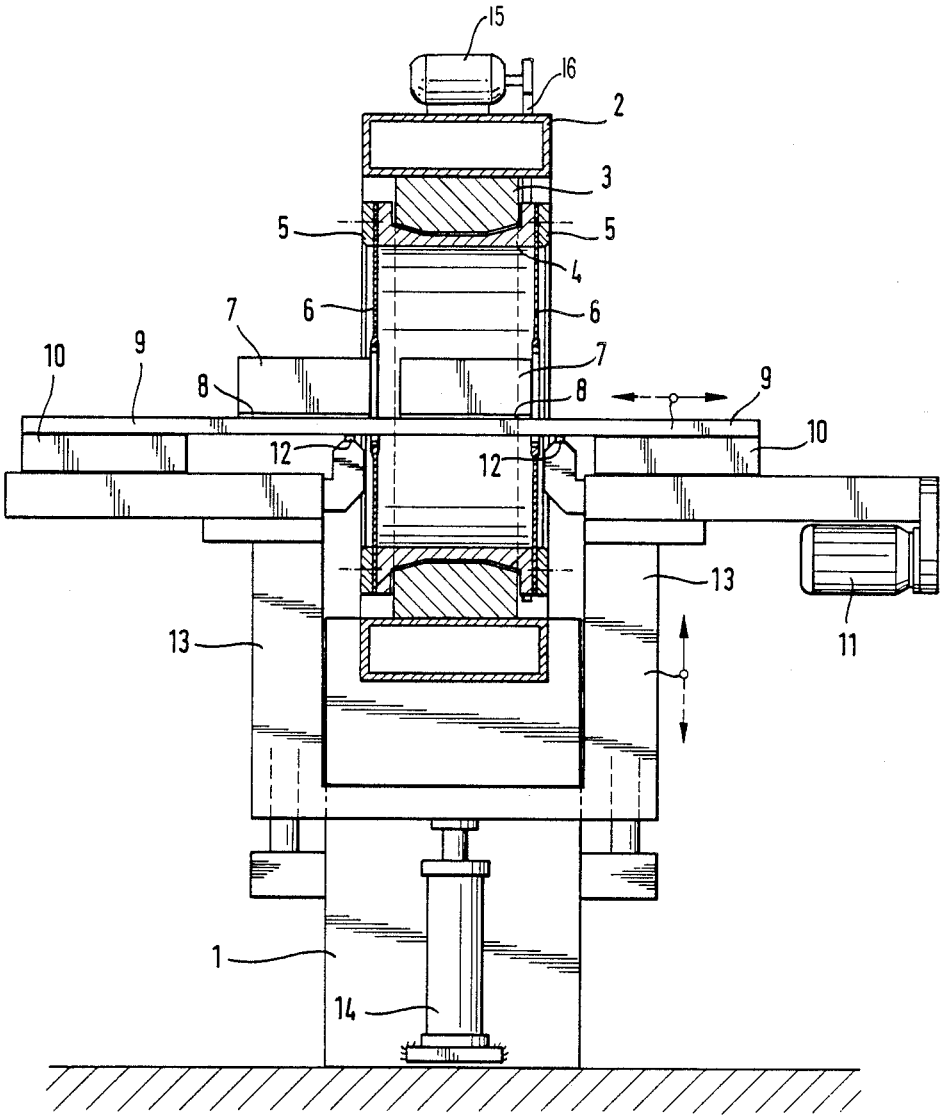
FIG. 1 is schematic, perspective, partially cut-away view of a portion of a multi-blade inner hole saw according to the present invention.
Figure 2:
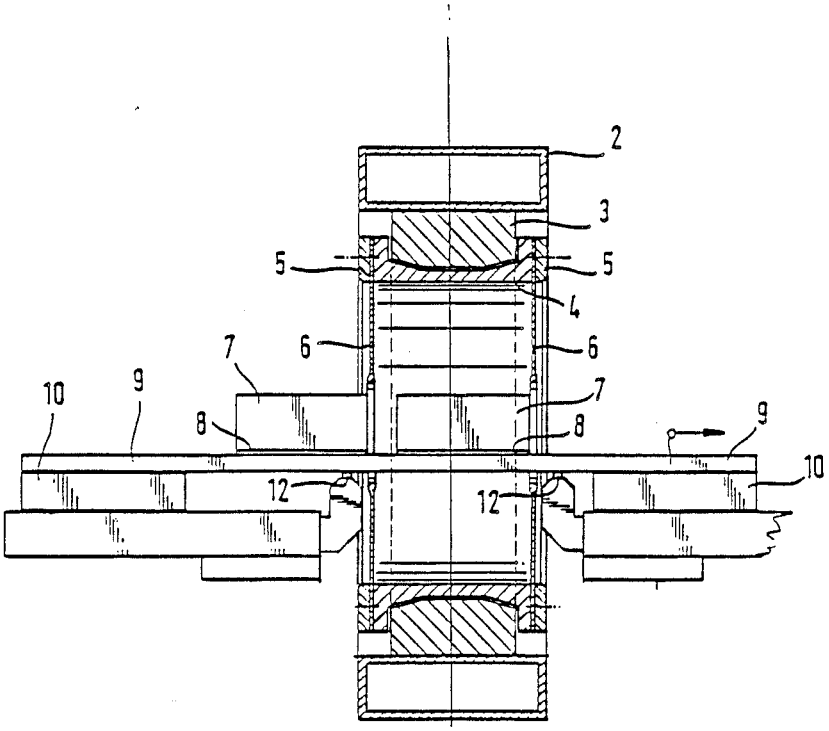
FIG. 2 is a side elevational view of the multi-blade inner hole saw of FIG. 1.

With reference to FIGS. 1 and 2, one embodiment of a multi-blade inner hole saw according to the invention, and a method for using the same in a sawing operation will now be explained. The embodiment of FIGS. 1 and 2 is only used for illustrative purposes, however, and the present invention is not limited thereby.

A drive cylinder 4 located between the frame block 1 and frame superstructure 2 is carried by an outer annular bearing 3, such as an air, magnet or hydrodynamic bearing. Mirror-symmetrical to bearing 3, drive cylinder 4 is provided with a tensioning frame 5 which may be designed, for example, in a manner known from conventional inner hole saws and in each of which one saw blade 6 is braced. By use of corresponding multi-blade tensioning frames 5, with unchanged drive cylinder 4, the present arrangement may also be converted for use with more than two simultaneous cutting operations. According to the preferred embodiment, the internal diameters of the frame 5 and of the drive cylinder 4 are approximately of equal size, even if differing internal diameters are not excluded in principle.

For reasons of clarity, the actual drive unit, usually an electric motor 15, and the power transmission, advantageously a flat belt 16, by which the drive cylinder 4 and thus the saw blades 6 are set in rotation, are not shown. In principle, the power transmission is also conceivable, for example, by means of V-belts or toothed belts.

The workpieces 7, such as crystal rods or blocks of cast, multi-crystalline silicon with columnar structure, are in some cases secured with an additional cutting underlay 8 on the workpiece support 9, by cement or adhesion. Support 9 lies with either end on an in-feed carriage 10 and can execute translational movements by means of a drive 11, such as a stepping motor, to bring the workpieces into the intended cutting position. Advantageously, workpiece support 9 may also be supported by pneumatic or hydraulic props 12.

Figure 3:
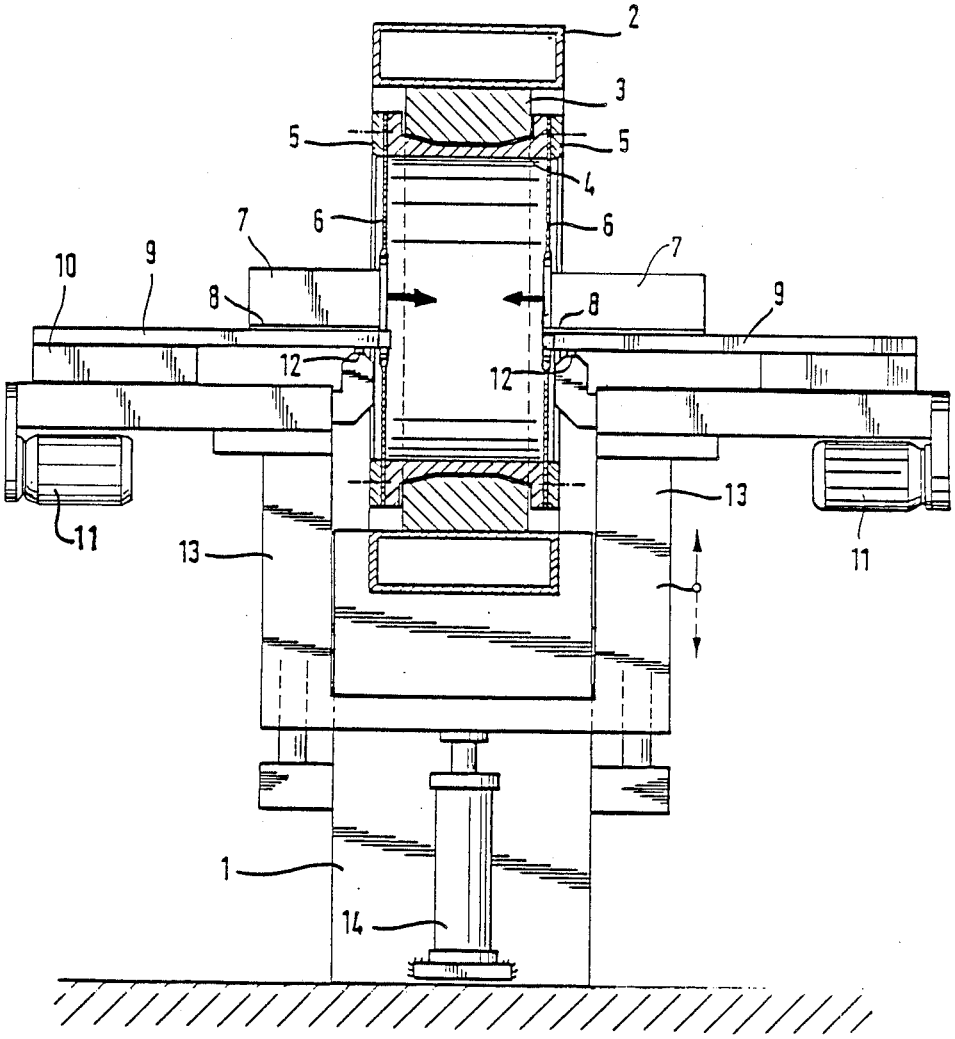
FIG. 3 is a side elevational view of the multi-blade inner hole saw of FIG. 1 in which the workpieces are moved in a counter-direction translational movement.

This embodiment, in which a workpiece support 9 bridges the in-feed carriages 10, is guided through the inner hole opening of both saw blades 6 and drive cylinder 4, and rests at either end are preferable within the scope of the invention. In particular, the use of the additional props 12 is preferred, as it ensures a particularly favorable vibrational behavior during the sawing operation. Naturally, however, arrangements are also conceivable with two separate workpiece supports 9, each resting on one side and with the free end facing the saw blades in each case and executing a counter-direction translational movement of the workpieces (FIG. 3).

The feed, which effects a relative vertical movement between workpieces 7 and rotating saw blades 6 during the actual sawing operation, takes place with the aid of the feed carriage 13 and can preferably be controlled hydraulically by means of a feed cylinder 14, but also by means of another drive, such as an electric motor.

Naturally, the embodiment of the saw according to the present invention presented by way of example herein, does not exclude variations of the kinematics, that is, in-feed and feed by translational movement, of the drive cylinder 4 with stationary workpieces 7 or arrangements with stationary drive cylinder 4. In addition, embodiments are conceivable which are provided, for example, with additional devices for the removal of severed wafers, for example, according to U.S. Pat. No. 4,445,494, the entire disclosure of which is incorporated herein by reference, or with filling stations which, in the case of cutting operations in which the crystal rods are dissected into a plurality of wafers joined to one another, fill the kerfs between the wafers and thus stabilize the joining of the wafers.

By means of the multi-blade inner hole saw represented in FIG. 1, silicon blocks 7 of solar cell base material, which typically have a cross-section of $10\times 10$ cm and a length of about 30 cm, can be sawn according to the operation described below. First of all, these blocks 7, which are advantageously provided on their underside 8 with a cutting underlay of, for example, glass, ceramic or carbon, are secured by bracing, adhering or cementing the same on the workpiece support 9. In so doing, one of the blocks 7 comes to rest outside and one inside the two saw blades 6, which are for example, about 35 cm away from each other (e.g. with an external diameter of about 55 cm and an inner hole diameter of about 18 cm). The blocks are advantageously positioned such that both assume an identical position relative to the saw blade 6 acting on them. Although such an identical relative position of the blocks 7 to the saw blades 6 is not absolutely necessary, it is recommendable if only with regard to an optimum cutting yield and an even loading of the saw blades 6 and bearings 3 during the entire sawing operation.

Figure 4:
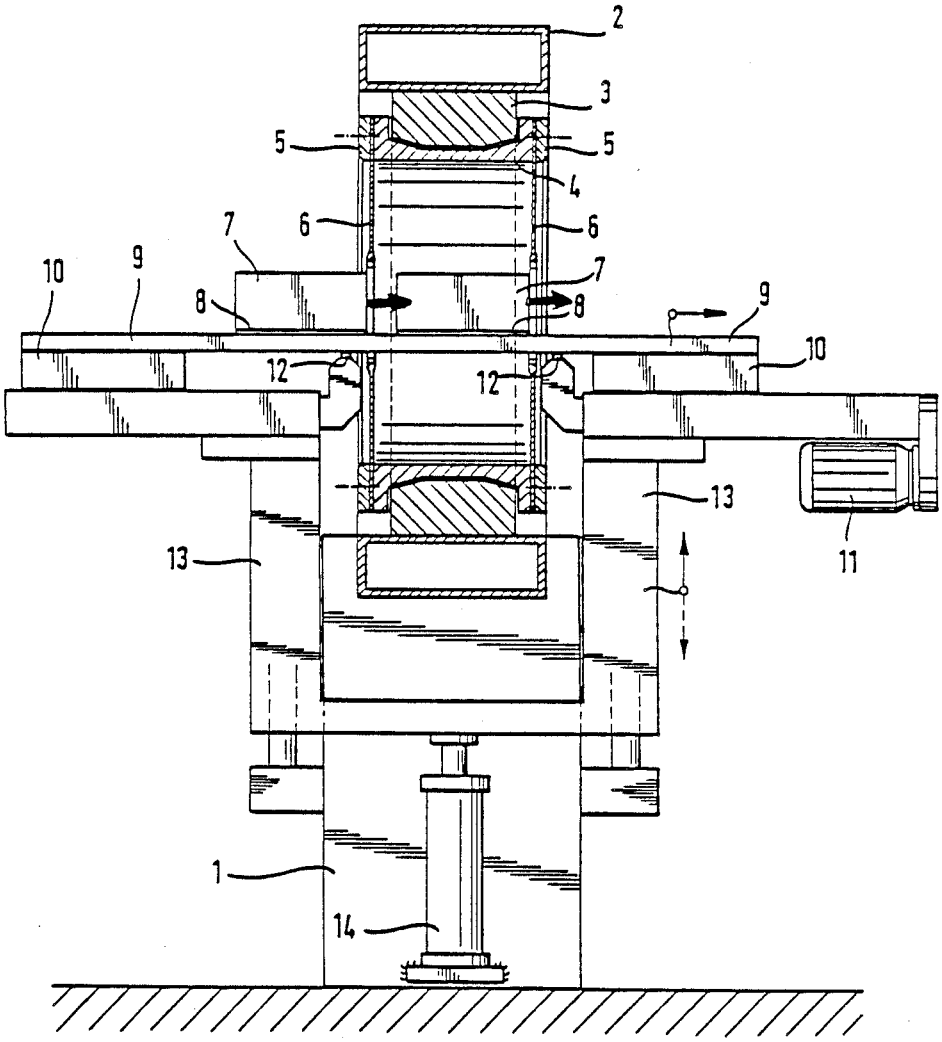
FIG. 4 is a side elevational view of the multi-blade inner hole saw of FIG. 1 in which the workpieces are moved in a same-direction translational movement.

Thereafter, both blocks 7 are moved simultaneously, by a translational movement of the workpiece support 9, into the inner opening of the saw blades 6, as shown in FIG. 4, until the intended cutting position is reached. An upward movement of the feed carriage 13 then takes the blocks 7 against the diamond-tipped, cutting edge of the rotating saw blades 6, which begins to work progressively further into the respective workpiece 7, forming a kerf, until finally the desired wafer has formed. In the case of saws of the type corresponding to FIG. 1, with which no wafer removal is provided, the wafer is not completely severed from the remaining block, but a joint is left, ensuring a stable retention of the wafer, preferably via the cutting underlay 8. Then the feed carriage 13 is returned to the initial position, the workpiece carrier moves both blocks 7 simultaneously to the next cutting position and the next cut is made in the workpiece 7 by an upward movement of the feed carriage 13. This operation is repeated until the blocks 7 are sawn, in the desired manner, i.e. by leaving impure portions or edge portions, if necessary, into a plurality of wafers joined to one another. The blocks are then removed, so that finally, by separating the joints by grinding off, sawing off, melting, dissolving or the like, the individual wafers can be obtained.

A variant of this sawing operation is also conceivable in which the initial position of both blocks 7 lies on the outside of the saw blades 6 and their translational movement leads in a counter-direction into the inside of the drive cylinder, as shown in FIG. 3. However, this mode of operation requires a considerable spacing of the saw blades 6 from each other to receive both blocks 7. To reduce the space requirement, it may therefore be necessary to saw the workpieces 7 initially only half way, return them then to the initial position, turn them through 180°, and finally to continue the sawing operation from the other end. A reduction in the space requirement may also be achieved by sawing the workpieces 7 in several stages and removing the sawn section in each case.

Generally, such sawing operations in which initially the wafers are not completely severed from the remaining block 7 (so-called comb cut) are preferred in the scope of the invention as it is possible to dispense with the often complex removal devices. Naturally, however, the sawing operations with complete severance and removal of the wafers are not excluded. At the same time, variants with outerlying or inner-lying wafer removal (in-feed of the work-pieces by counter-direction translation from inside to outside or from outside to inside) or with one-sided inner-lying, one-sided outerlying wafer removal (with in feed of the workpieces by a same-direction translation) may be used.

During the sawing operation, the heat produced and the generated material removed is carried away in the usual manner by a coolant, which reaches the separating point, for example, via a hose system, and can flow off through a system of slits and finally can be collected and fed in again, in some cases after a reprocessing stage. The control of the feed or of the in-feed may also take place in a known manner, manually, but preferably by means of hydraulics or a stepping motor.

The multi-blade inner hole saw according to the present invention and the sawing operations carried out by means of this saw are suitable in particular for the sawing of solar cell base material on silicon bases, which is usually obtained by a casting process in the form of silicon blocks with about $10\times10$ cm cross-sections and about 20 to 40 cm lengths, into wafers of usually 350 to 500 m thicknesses. Equally, however, the semiconductor or oxidic materials mentioned at the start may be sawn into thin wafers of 0.1 to 1 mm thickness. Furthermore, other materials in rod form, such as quartz or other glass, or rods on a carbon base, may also be dissected into thin wafers of up to 30 mm thickness.

Owing to the mirror-symmetrical design, equal loads act on the saw blades and bearings during sawing. This produces a higher cutting accuracy, improved running characteristics, more even saw blade stressing and long service lives in comparison with conventional multi-blade inner hole saws. At the same time, the ease of repairs is greater as, in the event of defects on one of the saw blades, only the defective one has to be exchanged in each case.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention as defined in the appended claims.

What is claimed is:

1. A multi-blade inner hole saw comprising:

a common drive cylinder;

a bearing system surrounding said common drive cylinder; and at least two saw blades arranged mirror symmetrically with respect to said bearing system on both sides of said common drive cylinder for simultaneously cutting at least two crystal workpieces into thin discs, the number of saw blade means corresponding to the number of workpieces, each saw blade means being positioned to cut one respective workpiece during said simultaneous cutting.

2. A multi-blade inner hole saw according to claim 1, wherein said at least two saw blades means include at least two saw blades.

3. A multi-blade inner hole saw according to claim 1, wherein said at least two saw blade means include at least two saw blade groups.

4. A multi-blade inner hole saw according to claim 1, wherein said at least two saw blade means are spaced from each other by a distance greater than the length of a workpiece to be sawn.

5. A multi-blade inner hole saw according to claim 1, wherein each saw blade means and said drive cylinder has an inner hole opening; and further comprising a workpiece support guided through the inner hole opening of both saw blade means and the drive cylinder and supported at outer ends thereof.

6. A process for the sawing of crystal rods by means of a multi-blade inner hole saw of the type including a common drive cylinder; a bearing system surrounding said common drive cylinder; and at least two saw blade means arranged mirror symmetrically with respect to said bearing system on both sides of said common drive cylinder for simultaneously cutting crystal workpieces into thin discs, said process comprising the steps of:

bringing at least two workpieces, the number of which corresponds to the number of saw blade means, into a respective cutting position before each cutting operation by (a) a same direction, or (b) counter direction translational movement, and simultaneously subjecting at least two workpieces to a sawing operation by synchronous relative movement between each saw blade means and each workpiece such that each saw blade means cuts one respective workpiece during said simultaneous sawing operation.

7. A process according to claim 6, further including the steps of:

dissecting the crystal rods in the sawing operation into a plurality of wafers joined to one another, and separating the wafers after completion of the sawing operation, in an additional stage.

8. A process according to claim 6, further including the steps of:

completely severing the wafers from the crystal workpiece in each sawing operation, and removing the wafer by means of a removal device.

* * * * *